US005356530A

United States Patent [19]

Calderon

[11] Patent Number: 5,356,530

[45] Date of Patent: Oct. 18, 1994

[54] METHOD FOR UPGRADING PETROLEUM RESIDUUM AND HEAVY CRUDE OIL

[76] Inventor: Albert Calderon, P.O. Box 126, Bowling Green, Ohio 43402

[21] Appl. No.: 961,670

[22] Filed: Oct. 16, 1992

[51] Int. Cl.[5] ..... C10G 47/02

[52] U.S. Cl. ..... 208/108; 208/50; 208/106; 208/107; 208/110; 208/112; 208/113; 208/120; 208/125; 48/197 R

[58] Field of Search ..... 208/106, 107, 108, 50, 208/110, 112, 113, 120, 125; 48/197 R

[56] References Cited

U.S. PATENT DOCUMENTS

| | | | |
|---|---|---|---|
| 3,876,527 | 4/1975 | Dugan et al. | 208/125 |
| 4,124,628 | 11/1978 | McRobbie | 260/449 |
| 4,276,150 | 6/1981 | McHenry, Jr. | 208/120 |
| 4,399,026 | 8/1983 | Shiroto et al. | 208/216 PP |
| 4,465,587 | 8/1984 | Garg et al. | 208/87 |
| 4,511,459 | 4/1985 | Yan et al. | 208/127 |
| 4,542,114 | 9/1985 | Hegarty | 502/39 |
| 4,673,486 | 6/1987 | Orihashi et al. | 208/86 |
| 4,839,023 | 6/1989 | Mayer et al. | 208/50 |
| 4,872,971 | 10/1989 | Zandona | 208/419 |
| 4,927,430 | 5/1990 | Calderon | 48/197 R |
| 5,136,808 | 8/1992 | Calderon | 48/62 R |

OTHER PUBLICATIONS

Speight, James G., Chem./Tech. Petroleum, 2nd ed., 1991, pp. 197–208.

World Bank Technical Paper 32, Entitled "World Refinery Industry—Need for Restructuring", p. 120, Wijetilleke et al., Nov. 1984.

U.S. DOE Solicitation No. DE-PS22-92BC14809; Dec. 11, 1991, pp. 1-2, "Upgrading Residuum and Heavy Crude Oils".

1988 Refining Handbook, Sep. 1988, p. 76, "Coking".

*Primary Examiner*—Johann Richter
*Assistant Examiner*—Michael B. Hydorn
*Attorney, Agent, or Firm*—Marshall & Melhorn

[57] ABSTRACT

A method for upgrading a petroleum material comprises charging the material into a vessel having a cylindrical wall, then heating the cylindrical wall. The petroleum material adjacent the wall is heated to a temperature sufficient to form a layer of carbon on the wall, and volatile material generated at the wall during the carbon formation passes through the bulk of the petroleum material thermally cracking it to form smaller molecules and simultaneously desulfurizing same.

13 Claims, 6 Drawing Sheets

METHOD FOR UPGRADING PETROLEUM RESIDUUM AND HEAVY CRUDE OIL

BACKGROUND OF THE INVENTION

The instant invention relates to applicant's issued U.S. Pat. Nos. 4,927,430 and 5,136,808 . The method herein disclosed is a new and continuous process to upgrade residuum and heavy crude oil without producing by-product coke or other waste. In addition, oily refinery wastes (U.S. EPA designated "K-Wastes") can be co-processed yielding valuable, non-hazardous products. The method is a closed system and is thermally self-sufficient.

The crude oil available to refiners is becoming heavier and declining in quality; further the sulfur content in the crude is on the increase. This causes the production of vast quantities of a by-product called "residuum," a low value, asphalt-like residual material which is becoming difficult to market. Conventionally the residuum is mixed with a high value cutter stock (thinner) and converted to residual fuel oil. The residual fuel oil possesses excessive quantities of sulfur which makes this fuel, when combusted, unacceptable to current and foreseeable environmental standards. The World Bank, in its Technical Paper Number 32, entitled "World Refinery Industry—Need for Restructuring," page 120, paragraph 7.23, states the following: ". . . there will be substantial deficits in middle distillates, and large surplus of residual fuel oil."

The U.S. Department of Energy (DOE), in its Program Solicitation DE-PS22-92BC14809 issued on Dec. 11, 1991, pages 1 and 2, paragraphs 4 and 1 respectively, is encouraging the development of ". . . better ways to convert heavy crude oil and the residuum fraction of conventional crudes to high quality light products." Further, the U.S. DOE's objective is to ". . . increase the use of residuum and heavier hydrocarbon feedstock in the production of light, environmentally acceptable fuels, by increasing process yield and reducing carbon rejection in the form of coke. This research is essential to the efficient upgrading and processing of heavy hydrocarbons."

In conventional practice residuum (hereinafter referred to as "resid") is coked to produce petroleum coke in a "Delayed Coker" which is the process most widely used. However, as stated above, the goal is not to reject carbon in the form of coke because petroleum coke has high sulfur and heavy metals and therefore there is no market for it. A process known as "Flexicoking," which is proprietary of Exxon, uses fluidized bed coking integrated to coke gasification. The disadvantages of the Flexicoke process are as follows:

- It does not provide for variable temperature control in the reactor to process a wide range of resids and crudes;
- Steam is injected into the reactor;
- Requires a gas plant to separate the complicated mixture of $C_1$ to $C_4$ hydrocarbons;
- Does not produce directly clean gas which is rich in $H_2$ needed in hydro-processing;
- Cannot produce syngas ($CO+H_2$) without a dual gasification;
- Does not produce a vitrified slag which is inert;
- Does not treat the gas produced for sulfur removal while the gas is hot;

- Uses steam in the gasification step to moderate temperature in gasifier;
- Does not co-feed a desulfurizer with the resid;
- Uses a scrubber;
- Circulates reactor coke to a heater for temperature pickup;
- Is not modular in construction.

With the above and other considerations in view, the main object of this invention is to provide a new, improved and continuous method to upgrade resid and heavy crude oil to produce lighter liquids economically and in an environmentally acceptable manner.

Still an object of the present invention is to provide a method that is efficient in heat transfer when processing the resid or crude oil.

Therefore an object of the present invention is to provide a method that is adapted to control the temperature when processing the resid or crude oil in order to make possible the processing of a wide range of resids and crudes.

Yet an object of the instant invention is to provide an improved method which is capable of processing resids and crudes without the implementation of steam during the coking step or during the gasification of the carbon.

Another object of the instant invention is to provide a method that requires no gas plant to separate the complicated mixture of $C_1$ to $C_4$ hydrocarbons by directly producing a clean hydrogen-rich gas without the use of a dual gasification step.

Still another object of the present invention is to provide a method that produces no ash but a vitrified inert slag which can be used for road ice control or abrasives and which will not leach.

Therefore another object of the present invention is to provide a method that treats the gas produced for sulfur removal in a hot gas cleanup.

Yet another object of this invention is to provide a method that is capable of processing resids and crudes while co-feeding the resids and crudes with a sulfur treating sorbent to further enhance the removal of sulfur.

Yet still another object of the present invention is to provide a method wherein the application of heat to the resid or crude oil for the rejection of carbon is carried out in such a way as to cause the rapid and efficient formation of carbon upon a heated surface and the stripping (removal) of said carbon from said surface in order to provide a freshly exposed heated surface for the additional application of resid or crude on said heated surface for the further rejection of additional carbon in a rapid and efficient manner, said rejected carbon being subsequently gasified to produce a gas which is treated for sulfur removal.

It is still another object of the present invention to provide a method wherein the hydrogen-rich gas produced is recycled for the treatment or hydro-cracking of the lighter liquids produced.

It is therefore another object of the present invention to provide a modular construction in order to make scale-up of the method predictable.

It is yet another object of the instant invention to provide a method that contains the above mentioned advantages and still requires a relatively low capital investment.

The above and other objects of the instant invention will become more apparent to those skilled in the art to which this invention pertains and particularly from the following description.

SUMMARY OF THE INVENTION

The invention herein described is a new and continuous method to upgrade resid and/or heavy crude oils without producing by-product coke or other wastes. In addition, oil refinery wastes (U.S. EPA designated "K-Wastes") can be co-processed yielding valuable, non-hazardous products.

The method comprises four major steps and incorporates technologies relating to pyrolysis, gasification, hot gas cleanup, and the production and application of the hydrogen produced to further enhance the yield of liquids co-produced. The method is a closed system and is thermally self-sufficient. The net products are a distillate liquid, sulfur, inert slag and steam or electric power.

Initially, residuum or heavy oil is pyrolyzed to produce volatile matter and carbon. This step is carried out on heated surfaces such as tubes, cylinders or the like which enable the control of the respective yields of volatile matter and carbon by promoting high heat transfer which is controllable for the optimum rate of devolatilization and for high throughput.

The volatile matter from pyrolysis is condensed to produce liquid products which are relatively light, and a non-condensable raw gas. This raw gas is cracked and desulfurized by coming in contact with a hot sorbent to yield a gas rich in hydrogen; the liquid product is further distilled or fed directly to a catalytic cracker or hydrocracker for converting it to a final product.

The hydrogen-rich gas may be used to hydrotreat the liquid product or to hydrocrack other products in the refinery for the enhancement of the quality of the liquids produced.

The carbon remaining from pyrolysis is gasified in an integrated slagging gasifier, which is air or oxygen-blown, but preferably air-blown, to produce a low-Btu gas and an inert slag which traps the heavy metals. This slag passes environmental tests for non-leachability.

The low-Btu gas produced from gasification of the carbon is desulfurized through a hot sorbent to result in a hot, lean low-Btu gas. A portion of this clean gas is used as the source of energy for the pyrolysis and hot gas cleanup steps. The remainder may be converted into electric power which can be used for heating or other purposes or for the generation of thermal energy in the form of steam.

Reference is now made to the accompanying drawings forming a part of this specification wherein like reference characters designate corresponding parts in the various views. It is to be understood that the embodiments shown herein are for the purpose of description and not limitation. Other embodiments or designs may be used without departing from the spirit of the invention.

BRIEF DESCRIPTION OF DRAWINGS

FIG. 5 is an illustration shown in part, describing the application of the liquid resid or crude against the wall of the pyrolysis tube, such application being accomplished by a piston which is adapted to move vertically while spraying the wall of said tube.

FIG. 6 is a view showing the carbon formation against the wall of the pyrolysis tube while the piston is in the top position.

FIG. 7 shows a representation describing the completion of the stripping of the carbon by the piston which is in the bottom position.

FIG. 8 is another variation of a design for pyrolyzing the resid being represented by a revolving cylinder.

Before proceeding with the detailed description of the invention, reference will be made to the above Figures for explaining the processing of resid. It is to be understood that crude oil, sludges and wastes containing hydrocarbons shall be included and shall be referred to by the word "resid" for simplicity of description. Again, it is to be understood that this invention is not limited to the details of the following description and the above-referenced Figures, since the invention is capable of having other embodiments without departing from the spirit of the invention, as such embodiments are within the capabilities of those skilled in the art to which this invention pertains. As for example, the shape upon which the application of the resid is carried out may be of different design and configuration. Further, it is to be understood that the phraseology or terminology herein set forth is for the purpose of describing the invention and not for the purposes of limiting it.

DETAILED DESCRIPTION OF DRAWING

Figure 1:
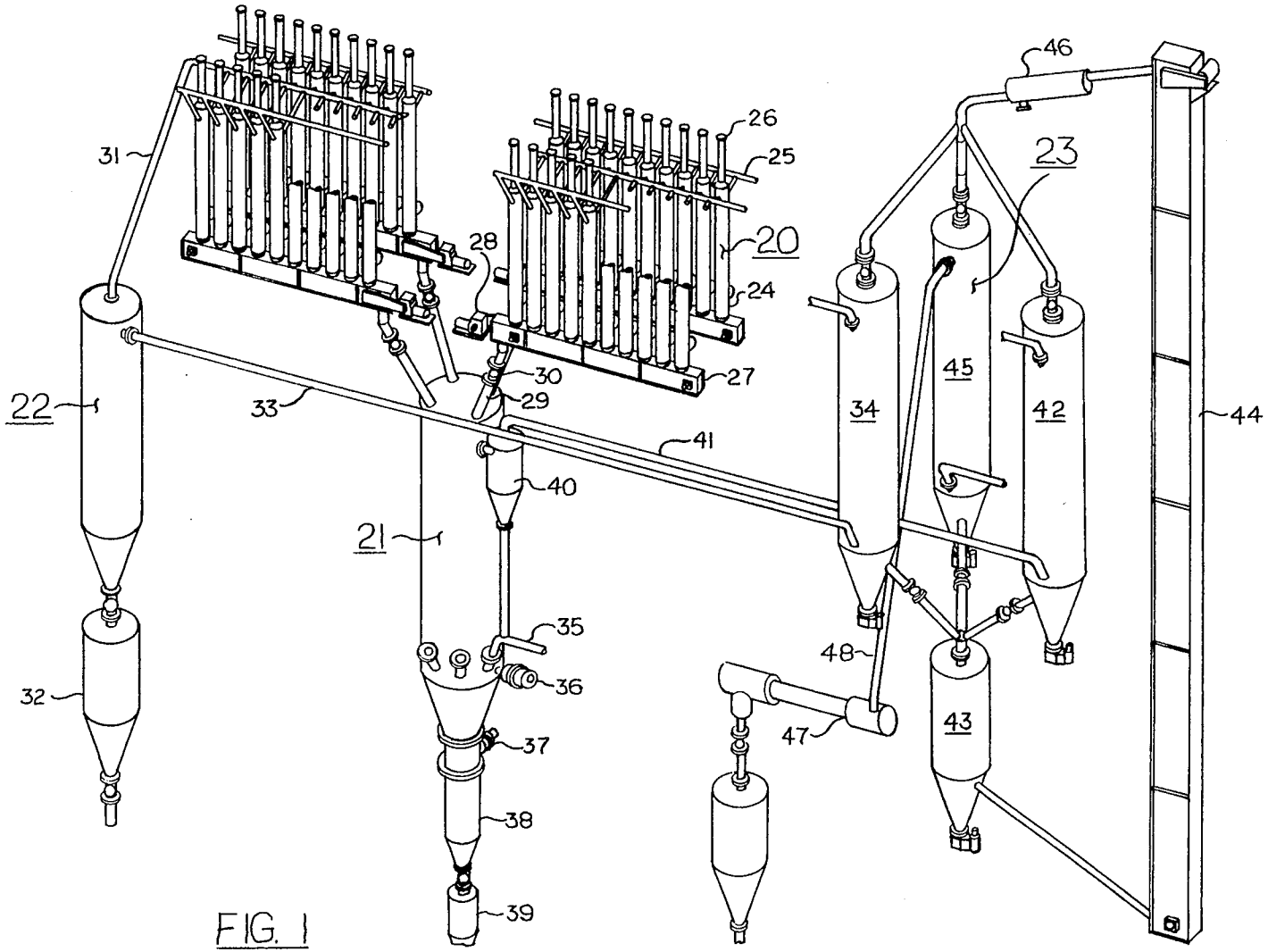
FIG. 1 is a schematic overview representation of the equipment which may be used in practicing the method.

Reference is made to FIG. 1. The numeral 20 represents one of several banks of pyrolysis tubes, 21 represents the gasifier, 22 represents the condenser and 23 represents the cleanup system for the gases produced.

Each bank of pyrolysis tubes 20 may comprise a group of tubes, and the assembly may possess several banks as for example four (4) banks in order to provide redundancy wherein three (3) banks would be operating while one (1) bank is being maintained. Each of said banks is made up of a plurality of tubes, and each single tube denoted by numeral 24, may be heated individually or the entire bank 20 may be heated from one source. Resid injection means is shown by numeral 25. This injection means may take the form of a distribution system such as a pump, valves and manifold, which is known in the art and is not shown herein. Each single tube is also equipped with a pushing mechanism marked by numeral 26. At the bottom of each bank 20 is a collection means such as a conveyor which is denoted by numeral 27. Conveyor 27 is equipped with a drive which is represented by numeral 28. Conveyor 27 possesses chute 29 for directing the carbon produced in tubes 24, into gasifier 21. A valve 30 is positioned in chute 29 to isolate bank 20 from the rest of the banks for maintenance. A collector for the volatile matter produced from pyrolysis, is denoted by numeral 31 which collector interconnects banks of tubes 20 to condenser 22. Condenser 22 possesses at its bottom liquid tank 32 and at its top, header 33 which leads to rich gas treater represented by numeral 34, where the non-condensable gas from condenser 22 is desulfurized and cracked against a hot sorbent to produce a hydrogen-rich gas.

Gasifier 21 is equipped at the bottom with tuyeres 35, start-up burner 36, slagging means 37, quench tank 38 and slag lock hopper 39; at the top of gasifier 21 cyclone 40 and header 41 are provided. Gasifier 21 may be air-blown or oxygen-blown, but preferably air-blown. Cyclone 40 removes the particulate matter from the gas produced in gasifier 21 and header 41 directs the gas to lean gas treater which is represented by numeral 42 where the lean gas from gasifier 21 is desulfurized and cracked also against a hot sorbent. The sorbent from both gas treaters 34 and 42 is directed to collection hopper 43 and recirculated by means of elevator 44 and directed to a sorbent regenerator represented by numeral 45. A particle remover such as a screen or trommel denoted by numeral 46 is positioned downstream of elevator 44. A sulfur condenser with a collection tank represented by numeral 47 is provided and is connected to regenerator 45 by means of pipe 48.

Figure 2:
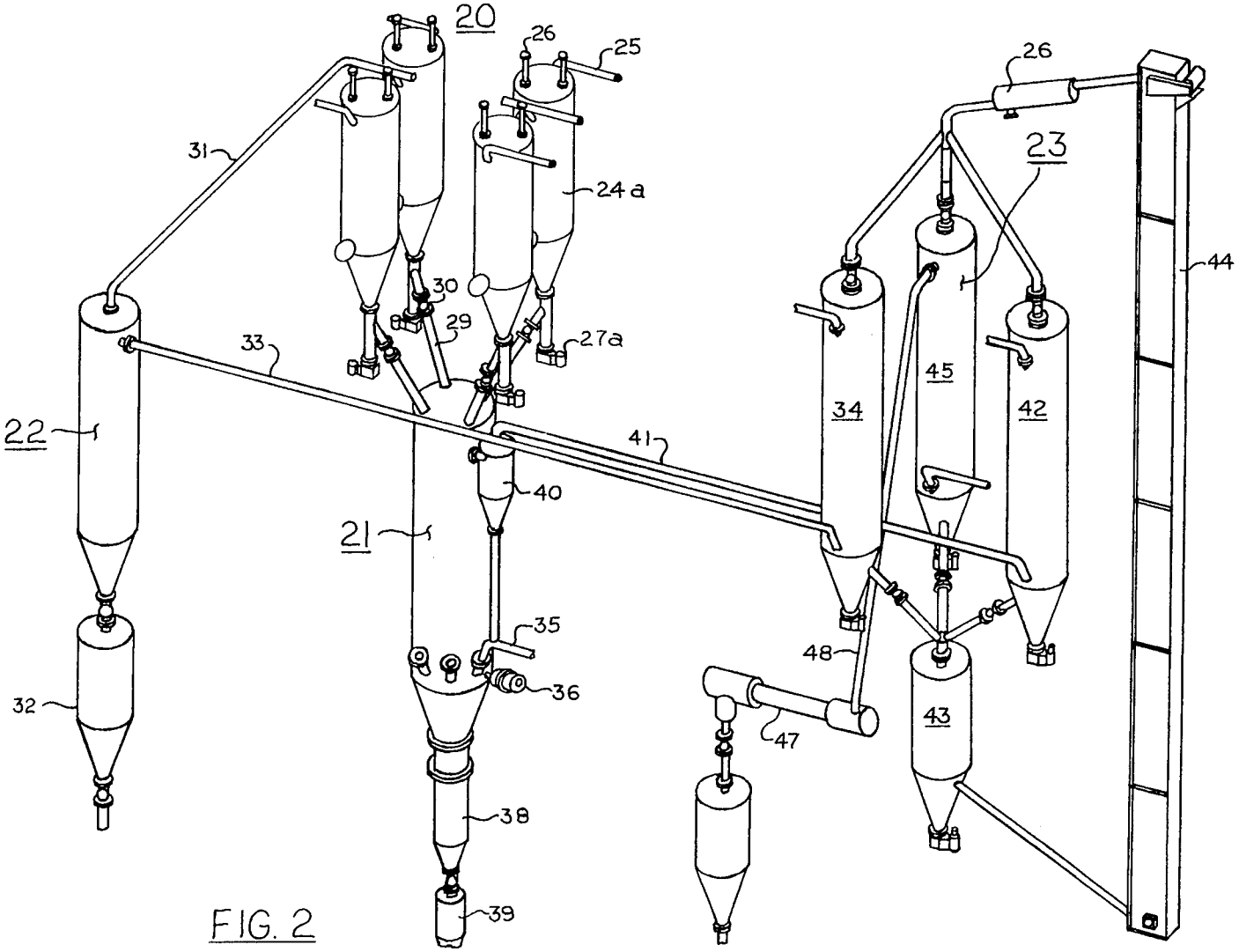
FIG. 2 is also a schematic overview representation of the equipment used in practicing the method showing an alternate tubular construction for pyrolysis.

FIG. 2 is an alternate embodiment of the invention wherein bank 20, representing a plurality of pyrolysis tubes such as tube 24, is replaced by a single large cylinder denoted by numeral **24*a*, and conveyor 27 represented by an auger and denoted by numeral 27*a*. The details of construction of cylinder 24*a* and auger 27*a* are illustrated in FIG. 3**.

Figure 3:
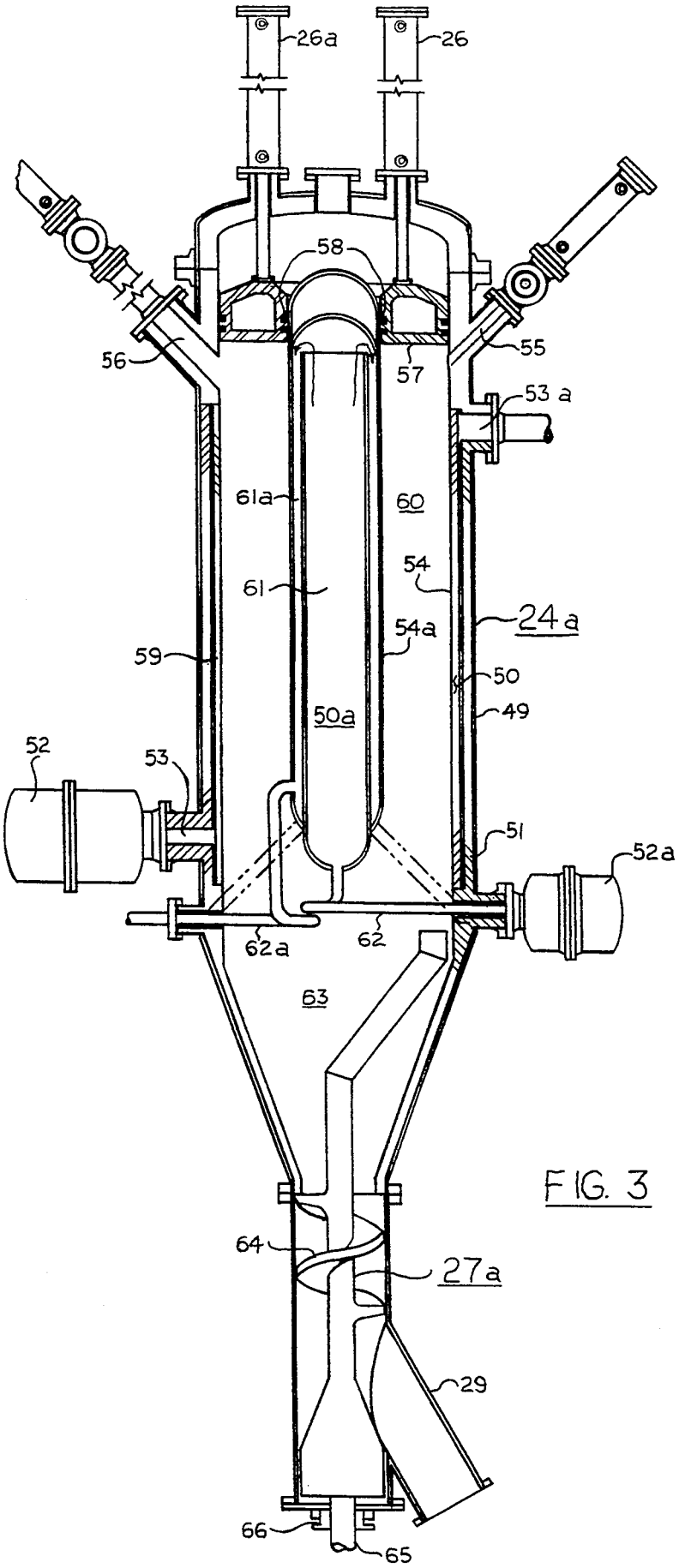
FIG. 3 is a detailed cross-sectional elevation of a pyrolysis tube shown in FIG. 2.

Referring to FIG. 3 for the detailed description of pyrolysis cylinder **24*a*, cylinder 24*a* possesses an outer shell shown by numeral 49 and a primary inner tube denoted by numeral 50; space 51 is provided for insulation between shell 49 and inner tube 50. Inner tube 50 is heated in any one of known ways as for example by burner 52 with flue gases from it flowing through port 53, flue passage 59, and exit port 53*a* in order to heat indirectly the inner wall of tube 50, which is denoted by numeral 54. A secondary inner tube denoted by numeral 50a is disposed within tube 50 in such a way as to have tube 50 surround tube 50*a* with space 60 provided for the resid to be contained between inner wall 54 of primary inner tube 50 and outer wall 54*a* of secondary inner tube 50*a*. Secondary inner tube 50*a* is constructed in such a manner as to have passage 61 and passage 61*a* for the flow of flue gas from burner 52*a*, port 62 directing the flue gas from burner 52*a* into passage 61 and port 62*a* directing the flue gas out of passage 61*a*. The heat is thusly applied to space 60 by both inner wall 54 and outer wall 54*a*** for the formation of carbon against these two walls.

Pushing mechanisms 26 and **26*a*, which serve to strip the carbon from walls 54 and 54*a* and push the carbon out of space 60, are disposed to piston 57, which in turn is equipped with scrapers such as scraper rings 58. A conical hopper forming the bottom of pyrolysis cylinder 24*a* and denoted by numeral 63, is used to collect the carbon stripped from walls 54 and 54*a* and from space 60. A device such as auger 27*a* is disposed at the bottom of cone 63; this auger possesses flights 64, shaft 65 and drive 66 to remove the carbon from cone 63 and discharge it into chute 29 which leads to gasifier 21 shown in FIG. 2. Tube 24*a* is equipped with a charging port denoted by numeral 55 for the introduction of the resid, and a discharging port denoted by numeral 56** for the removal of the volatile matter.

Figure 4:
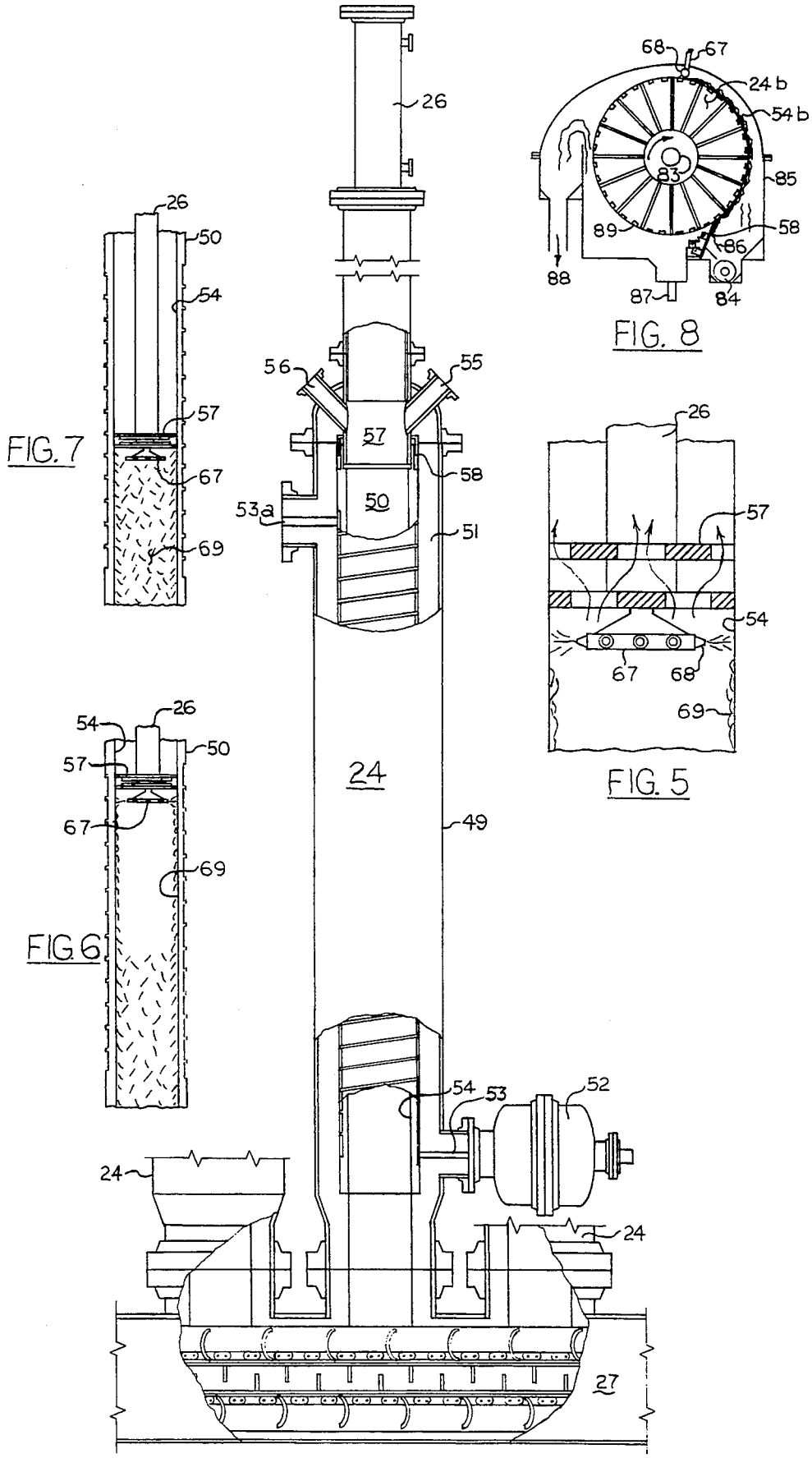
FIG. 4 is an elevation of one of the pyrolysis tubes used for converting the resid or crude to volatile matter and carbon shown in FIG. 1.

Reference is now made to FIG. 4 for the detailed description of pyrolysis tube or cylinder 24, which is one of several represented by bank 20 in FIG. 1. Tube 24 possesses an outer shell shown by numeral 49 and an inner tube denoted by numeral 50; space 51 is provided for insulation between shell 49 and inner tube 50. Inner tube 50 is heated in any one of known ways, including electrically using induction or resistance means. By way of example, burner 52 is provided with its flue gas leaving port 53, spiralling around the periphery of the outer wall of tube 50 and exiting through port **53*a*, in order to heat inner wall 54 of inner tube 50, against which inner wall the resid is carbonized. Ports 55 and 56 are provided to tube 24; port 55 serves for the introduction of resid into inner tube 50 and port 56 serves as an exit for the volatile matter produced from the pyrolysis of the resid in inner tube 50. Pushing mechanism 26, which serves to strip the carbon from inner wall 54 and to push the carbon out of tube 50, possesses piston 57 which, in turn, is equipped with scrapers 58 to strip the carbon from inner wall 54 and push the carbon onto conveyor 27**.

Deviations in configuration and designs are herein disclosed in order not to limit the invention to the specific apparatus described. FIG. 5 shows piston 57 equipped with a spraying head denoted by numeral 67 as an integral part of piston 57 for spraying the resid through nozzles 68 against heated inner wall 54 for the thermal cracking of the resid against inner wall 54, the carbon formed against inner wall 54 being denoted by numeral 69.

FIG. 6 and FIG. 7 are for the purpose of further clarification of FIG. 5; they illustrate the movement of piston 57 in tube 50. Piston 57 is adapted to move up and down vertically within tube 50. In the upward stroke shown in FIG. 6, the resid is sprayed against heated wall 54 to thermally crack the resid and deposit carbon on wall 54 and in this manner reject carbon from the resid and cause volatile matter to be released and then collected. In the downward stroke shown in FIG. 7, the carbon is stripped from wall 54 and in this manner the carbon, denoted by numeral 69, is directed to conveyor 27 which, in turn, feeds it to gasifier 21 as shown in FIG. 1 or FIG. 2.

FIG. 8 is still another variation in design. Instead of using a vertical cylinder whose wall is heated into which the resid is fed or the resid is sprayed, a rotary heated cylinder may be provided. The carbon, after being formed, is scraped or stripped from the surface. In describing this configuration, numeral **24*b* represents the general assembly of the rotary cylinder and 54*b* is the surface against which the resid is applied or sprayed by means of applicator 67 and/or spray head 68. Surface 54*b* may be heated in any of many ways such as by gas or electricity and by way of example, strip-heaters 89 are shown which are mounted beneath surface 54*b*. Rotary cylinder 24*b* rotates about shaft 83. A scraper or stripping bar denoted by numeral 58 is applied against surface 54*b* to strip the carbon away from surface 54*b*. The stripped carbon is denoted by numeral 86. A cover 85 envelops the entire assembly for confining fumes. A drain 87 is provided for removing any of the resid which does not carbonize. The carbon itself is removed from the assembly by a conveyor such as screw conveyor 84, and the volatile matter is collected via downcomer 88**.

DESCRIPTION OF OPERATION

In describing the operation of the instant invention by way of example, one configuration will be described as illustrated in FIGS. 9 through 16 followed by an overall process flow diagram illustrated by FIG. 17. It is obvious that other configurations can be arranged by those skilled in the art to which this invention pertains. Therefore it is intended to include in this disclosure various arrangements for the formation of a skin of carbon from resid against a heated surface such as the formation against the inner wall of a tube or cylinder, or on the outer wall of a tube or a cylinder. Further the disclosure is inclusive of various arrangements for the thermal cracking of resid against a wall of a cylinder which is heated in a controlled fashion in order to drive volatile matter away from the wall and to form a skin of carbon from resid against the heated wall, the resid being sprayed against the wall or fed or applied against the wall which is heated. Further still the herein disclosure includes a heated surface upon which the skin of carbon is formed, whether such surface is fixed and a spraying means moves, or a spraying means being fixed and the heated surface upon which the skin of carbon is formed moves. Further yet the stripping of the skin of carbon may be moveable while the cylinder against which the skin is formed is fixed, or the stripping may be fixed while the cylinder moves.

Figure 9:
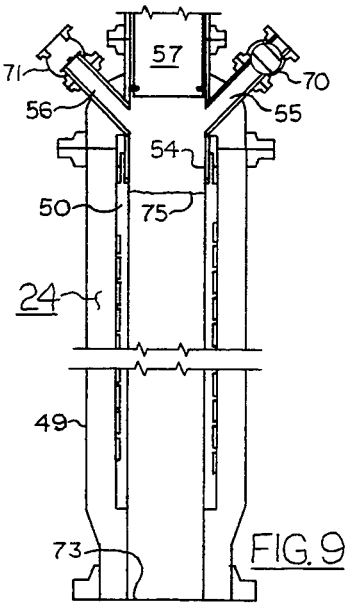
FIGS. 9 through 14 inclusive are the views showing the various steps of the cycle of injection of resid or crude, carbon formation and its stripping from the walls of the pyrolysis tube.
Figure 10:
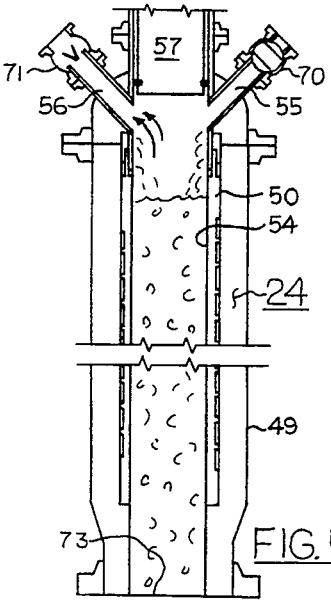
Figure 11:
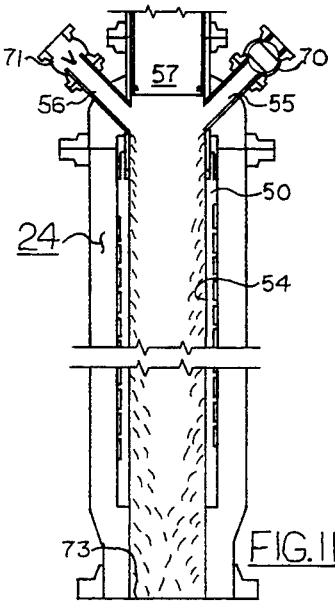
Figure 12:
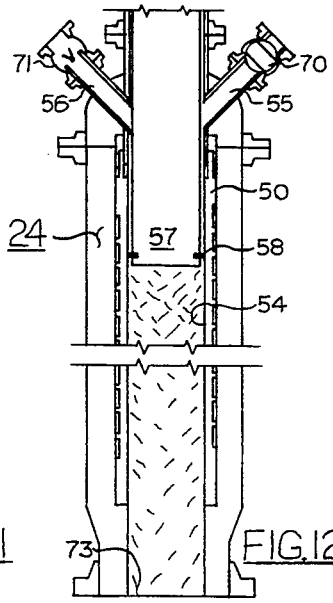
Figure 13:
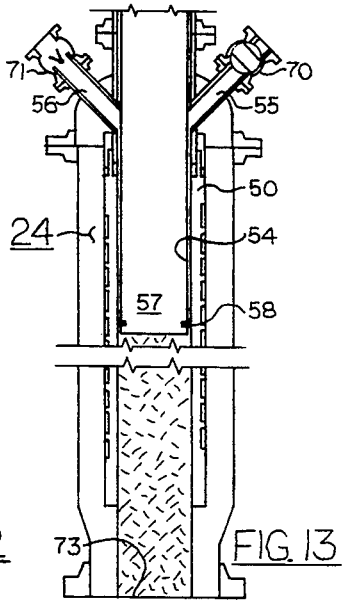
Figure 14:
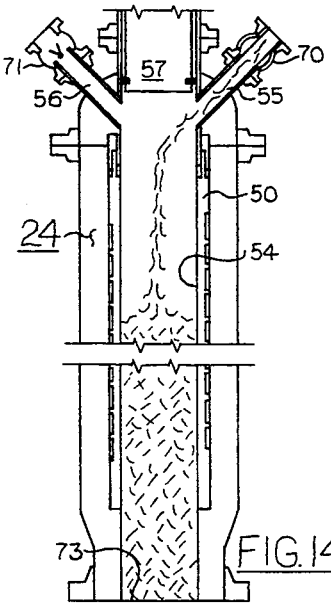
Figure 15:
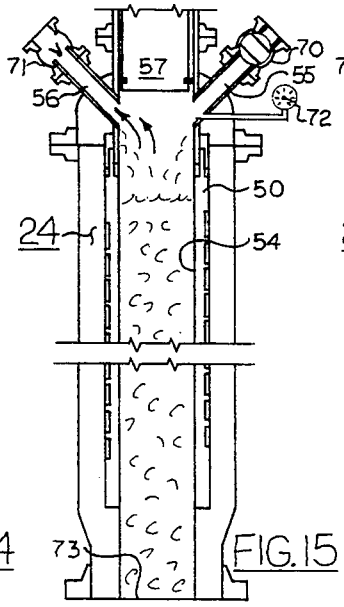
FIG. 15 is a view showing a pyrolysis tube pyrolyzing at pressure, resid or crude.
Figure 16:
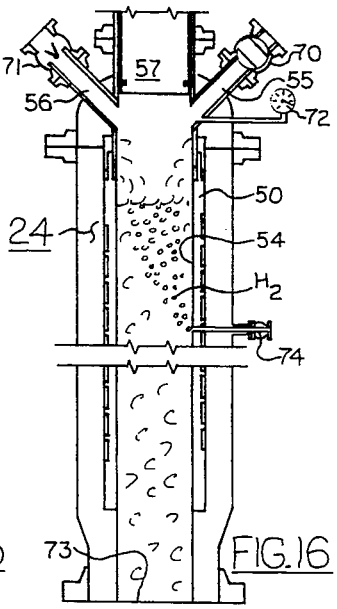
FIG. 16 is a view showing a pyrolysis tube, pyrolyzing the resid or crude while hydrogen and/or catalyst is being injected into the resid or crude to enhance the product yield, this being done at pressure.

Reference is now made to FIG. 9 which illustrates by way of example, the cylinder or tube 24 in which the resid is processed. It possesses port 55 for the introduction of the resid and port 56 for the evacuation of the volatile matter. The carbon is discharged through its open bottom denoted by numeral 73. Valve 70 is provided on port 55 to control the feed of the resid and valve 71 is provided on port 56 to control the evacuation of the volatile matter. The phase of the cycle shown in FIG. 9 is at the completion of the feed of the resid with its level illustrated by numeral 75. FIG. 10 illustrates the boiling of the resid with volatile matter leaving through port 56 while valve 71 is open. FIG. 11 shows the completion of the boiling action and the skin of carbon formed on heated wall 54 of tube or cylinder 50. FIG. 12 illustrates the stripping of the skin of carbon from hot wall 54 by piston 57 aided by scraper 58. FIG. 13 shows piston 57 at the bottom of its stripping stroke. FIG. 14 illustrates the retracted position of piston 57 and the feed of resid for the next cycle. FIG. 15 is a version of FIG. 10 wherein the process is conducted at pressure as indicated by pressure gauge 72. FIG. 16 is another version of FIG. 15 wherein the process is carried out at pressure while hydrogen ($H_2$) is injected through port 74 to further enhance the yield. It is also contemplated for a desulfurizer to be added to the resid to desulfurize the volatile matter while the carbon is being formed against hot wall 54. In addition to a desulfurizer, a catalyst may also be added to the resid which would enhance the reaction of upgrading. The heat applied to wall 54 and the pressure applied to the system are controlled to optimize both the carbon rejection from the resid and the thermal/chemical reactions taking place. This results in the breaking up of the long chain of hydrocarbons in the resid to produce hydrocarbons with smaller molecular structure while at the same time enhancing the API gravity of the liquid yield in the volatile matter through hydrotreating and hydrocracking to reduce sulfur and make the liquids lighter.

Figure 17:
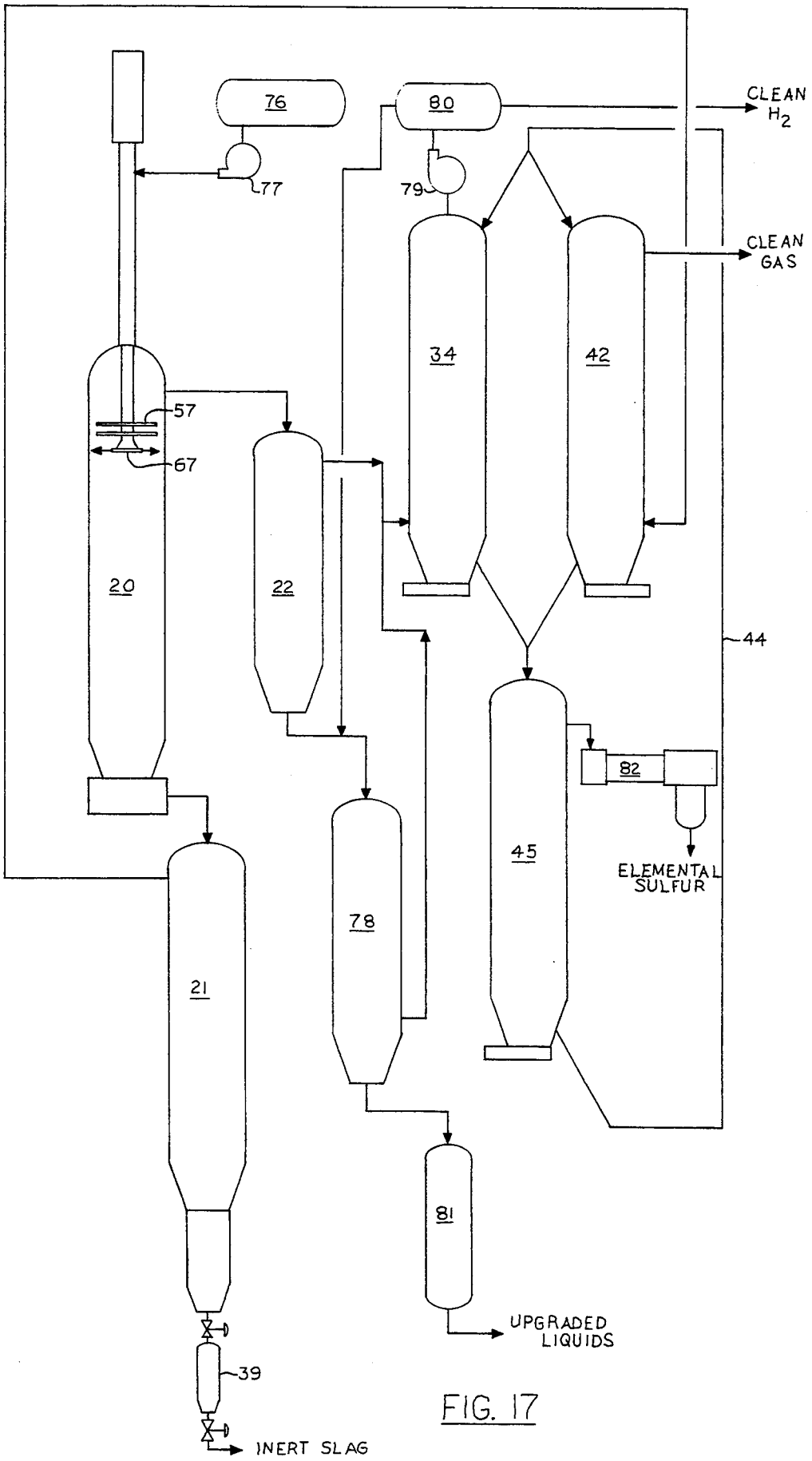
FIG. 17 is a general process flow diagram of the method described herein.

Referring to FIG. 17, which illustrates the general flow diagram of the method, numeral 20 represents cylinder means where the thermal cracking of the resid and the rejection of carbon against a heated wall takes place; the cylinder may be fixed or rotating. The resid, crude oil or oily sludge contained in tank 76 is pumped by means of pump 77 into or onto cylinder means 20, where it is applied on a heated wall. The carbon formed after being stripped, is fed to gasifier 21, where it is converted to a gas which comes into contact with a sorbent in cleanup system 42. The slag, which is the residue (heavy metals) from the gasification of the carbon, is withdrawn from the bottom of gasifier 21 through lock hopper 39. The volatile matter produced during the rejection of the carbon is separated into a liquid and a non-condensable gas in condenser 22. The condensed liquid is fed into a hydrotreater, which is denoted by numeral 78. The non-condensed gas from the top of condenser 22 is fed to the bottom of gas cleanup 34 to crack the hydrocarbons contained in the gas against a hot sorbent to produce a clean hydrogen-rich gas which leaves the top of cleanup 34 to be compressed by compressor 79 and stored in receiver 80. This hydrogen-rich gas is used with the liquid in order to hydrotreat or hydrocrack it in a means such as vessel 78. The sour gas from vessel 78 joins the non-condensed raw gas from condenser 22 and both are cleaned in hot gas cleanup 34. The enhanced liquid is directed from vessel 78 to storage 81. The sorbent in cleanup 34 and cleanup 42 is fed to regenerator 45, where the sorbent is regenerated yielding sulfur. The sulfur is condensed in condenser 82. After regeneration, the sorbent is recycled by means of carrier 44 into cleanup vessels 34 and 42 for additional use.

All in all, it is submitted that the present invention provides an improved method for the upgrading of residuum, heavy crude oil, and oil refinery sludges and wastes, which makes possible the efficient rejection of carbon from such materials in an environmentally acceptable manner and the production of valuable, lighter liquids from low-value materials. Further, the rejected carbon is consequently gasified in a closed system to produce a valuable gas and an inert slag which contains the heavy metals. Further still, the method produces a hydrogen-rich gas by cracking the non-condensable gas, which is useful in the treatment and enhancement of the liquids produced; the gas produced from gasification is consequently used to provide economical energy for the process and/or for the generation of electric power or steam.

I claim:

1. A method for upgrading a petroleum material comprising resid and heavy crude oil, to produce lighter liquids comprising:

charging the petroleum material into a vessel having a cylindrical wall to cause said material to come into contact with said wall;

heating said wall to a temperature sufficient to cause said material which is adjacent said wall to form a layer of carbon against said wall and vaporize volatile matter which is emitted during the formation of carbon away from said heated wall; and reacting said volatile matter with petroleum material which is not adjacent to said wall to thermally crack said petroleum material which is not adjacent to said wall to reduce the size of the molecular structure thereof and desulfurize that petroleum material which is not adjacent to said wall.

2. The method for upgrading a petroleum material according to claim 1, further comprising collecting the volatile material and condensing same to form a liquid portion and a non-condensable gaseous portion.

3. The method for upgrading a petroleum material according to claim 1, further comprising stripping the layer of carbon from the wall.

4. The method for upgrading a petroleum material according to claim 3, further comprising charging the carbon to a gasifier and forming a gas and ash from the carbon.

5. The method for upgrading a petroleum material according to claim 2, further comprising treating the non-condensable gaseous portion by contacting a hot sorbant to crack hydrocarbons contained in said gaseous portion to remove carbon and sulfur to yield a gas rich in hydrogen.

6. The method for upgrading a petroleum material according to claim 4, further comprising treating the gas with a sorbant to clean said gas.

7. The method for upgrading a petroleum material according to claim 4, wherein said gasifier is operated at a temperature sufficient to convert the ash to an inert slag.

8. The method for upgrading a petroleum material according to claim 1, wherein the petroleum material is adjacent the inside surface of the cylindrical wall.

9. The method for upgrading a petroleum material according to claim 1, wherein the petroleum material is adjacent the outside surface of the cylindrical wall.

10. The method for upgrading a petroleum material according to claim 1, wherein the petroleum material is charged into the vessel by spraying.

11. The method for upgrading a petroleum material according to claim 3, further comprising rotating the cylindrical wall while stripping the carbon therefrom.

12. The method for upgrading a petroleum material according to claim 1, further comprising injecting hydrogen into the vessel during the heating of the cylindrical wall.

13. The method for upgrading a petroleum material according to claim 1, further comprising introducing a catalyst into the vessel during the heating of the cylindrical wall.

* * * * *